US009201368B2

(12) United States Patent
Nanjo et al.

(10) Patent No.: US 9,201,368 B2
(45) Date of Patent: Dec. 1, 2015

(54) FIXING DEVICE AND IMAGE FORMING APPARATUS WITH INCLINED REGULATION SURFACE

(71) Applicant: KYOCERA Document Solutions Inc., Osaka-shi, Osaka (JP)

(72) Inventors: Yuzuru Nanjo, Osaka (JP); Masaru Takagi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/243,770

(22) Filed: Apr. 2, 2014

(65) Prior Publication Data

US 2014/0301760 A1 Oct. 9, 2014

(30) Foreign Application Priority Data

Apr. 4, 2013 (JP) ..... 2013-078498

(51) Int. Cl.
*G03G 15/20* (2006.01)

(52) U.S. Cl.
CPC ..... *G03G 15/2085* (2013.01); *G03G 15/2053* (2013.01); *G03G 2215/00151* (2013.01); *G03G 2215/2029* (2013.01)

(58) Field of Classification Search
CPC ..... G03G 15/2028; G03G 15/2053; G03G 15/2085; G03G 2215/00151
USPC ..... 399/329
See application file for complete search history.

(56) References Cited

U.S. PATENT DOCUMENTS

2009/0003900 A1* 1/2009 Shimizu ..... G03G 15/2053 399/329
2009/0317153 A1 12/2009 Lee
2012/0308279 A1* 12/2012 Tanaka ..... G03G 15/2053 399/329
2012/0315064 A1* 12/2012 Takifuji ..... G03G 15/1615 399/121
2013/0039683 A1* 2/2013 Fujita ..... G03G 15/2053 399/329

FOREIGN PATENT DOCUMENTS

| | | | |
|---|---|---|---|
| JP | 2007279671 A | | 10/2007 |
| JP | 2008-242177 A | * | 10/2008 |
| JP | 2010169737 A | * | 8/2010 |
| JP | 2010243898 A | | 10/2010 |
| JP | 2012254867 A | | 12/2012 |

OTHER PUBLICATIONS

European Patent Office, Extended European Search Report Issued in European Patent Application No. 14162846.1, Feb. 5, 2015, Germany, 6 pages.

* cited by examiner

*Primary Examiner* — Francis Gray
(74) *Attorney, Agent, or Firm* — Alleman Hall McCoy Russell & Tuttle LLP

(57) ABSTRACT

A fixing device includes a fixing roller, a pressure roller, and a regulation member. The fixing roller includes a roller member and a fixing belt. The roller member includes a shaft which extends in one direction and an elastic layer integrally formed on the shaft. Each regulation member has an annular regulation surface which opposes a side edge of the fixing belt, and is configured to regulate movement of the fixing belt in a rotation axis direction. The regulation surface is inclined relative to a line perpendicular to the rotation axis as viewed on a cross-section parallel to the rotation axis. The regulation surface is inclined from the rotation axis side such that the closer the regulation surface is to an outside, in a radial direction, of the fixing roller, the closer the regulation surface is to a center, in a length direction, of the shaft.

8 Claims, 15 Drawing Sheets

FIXING DEVICE AND IMAGE FORMING APPARATUS WITH INCLINED REGULATION SURFACE

INCORPORATION BY REFERENCE

This application is based upon and claims the benefit of priority from the corresponding Japanese Patent Application No. 2013-078498 filed on Apr. 4, 2013, the entire contents of which are incorporated herein by reference.

BACKGROUND

The present disclosure relates to fixing devices that fix toner images on sheets and image forming apparatuses.

A fixing device in an image forming apparatus includes a fixing nip portion formed by a fixing roller and a pressure roller being pressed against each other. When a sheet passes through the fixing nip portion, the sheet is pressurized and heated, thereby fixing a toner image on the sheet, onto the same sheet. A fixing roller in which a metal belt (fixing belt) is fitted onto an elastic roller member is known as the fixing roller. The fixing belt is heated by induction heating manner.

The fixing belt has an inner diameter that is greater than an outer diameter of the roller member at room temperature, and there is a clearance between the fixing belt and the roller member in the fitted state. When the temperature rises due to the fixing device being operated, thermal expansion occurs in the roller member, whereby the fixing belt and the roller member come into close contact with each other. Before the close contact state occurs, the fixing belt may meander in the axial direction of the fixing roller. Therefore, the movement of the fixing belt in the axial direction needs to be regulated. Thus, disk-shaped regulation members having regulation surfaces opposing side edges of the fixing belt are mounted near the axial ends of the fixing roller.

Further, when the fixing roller is pressed against the pressure roller, the fixing belt is deformed into an ellipsoidal shape by a deformation amount corresponding to the clearance. In this deformed state, a length of the major axis of the ellipsoidal shape of the fixing belt may be greater than the outer diameter of the regulation members. In this case, the side edges of the fixing belt repeatedly contact with the outer circumferential edges of the regulation members, and the side edges of the fixing belt are more likely to be damaged. Therefore, it is known that outer circumferential walls that prevent the side edges of the fixing belt from moving outward of the regulation members in the radial direction are provided on the outer circumferential edges of the regulation members.

SUMMARY

A fixing device according to one aspect of the present disclosure includes a fixing roller, a pressure roller, and a regulation member. The fixing roller includes a roller member and a fixing belt. The roller member includes a shaft which extends in one direction and an elastic layer integrally formed on the shaft. The fixing belt is fitted onto the roller member. The fixing roller is configured to rotate about an axis of the shaft as a rotation axis. The pressure roller is configured to form a fixing nip portion between the pressure roller and the fixing roller. The regulation member is mounted at end portions of the shaft, and each regulation member has an annular regulation surface which opposes a side edge of the fixing belt, and the regulation member is configured to regulate movement of the fixing belt in a rotation axis direction. The regulation surface is inclined relative to a line perpendicular to the rotation axis as viewed on a cross-section parallel to the rotation axis. The regulation surface is inclined from the rotation axis side such that the closer the regulation surface is to an outside, in a radial direction, of the fixing roller, the closer the regulation surface is to a center, in a length direction, of the shaft.

An image forming apparatus according to another aspect of the present disclosure includes an image forming portion that transfers a toner image on a sheet, and the fixing device that fixes the toner image onto the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
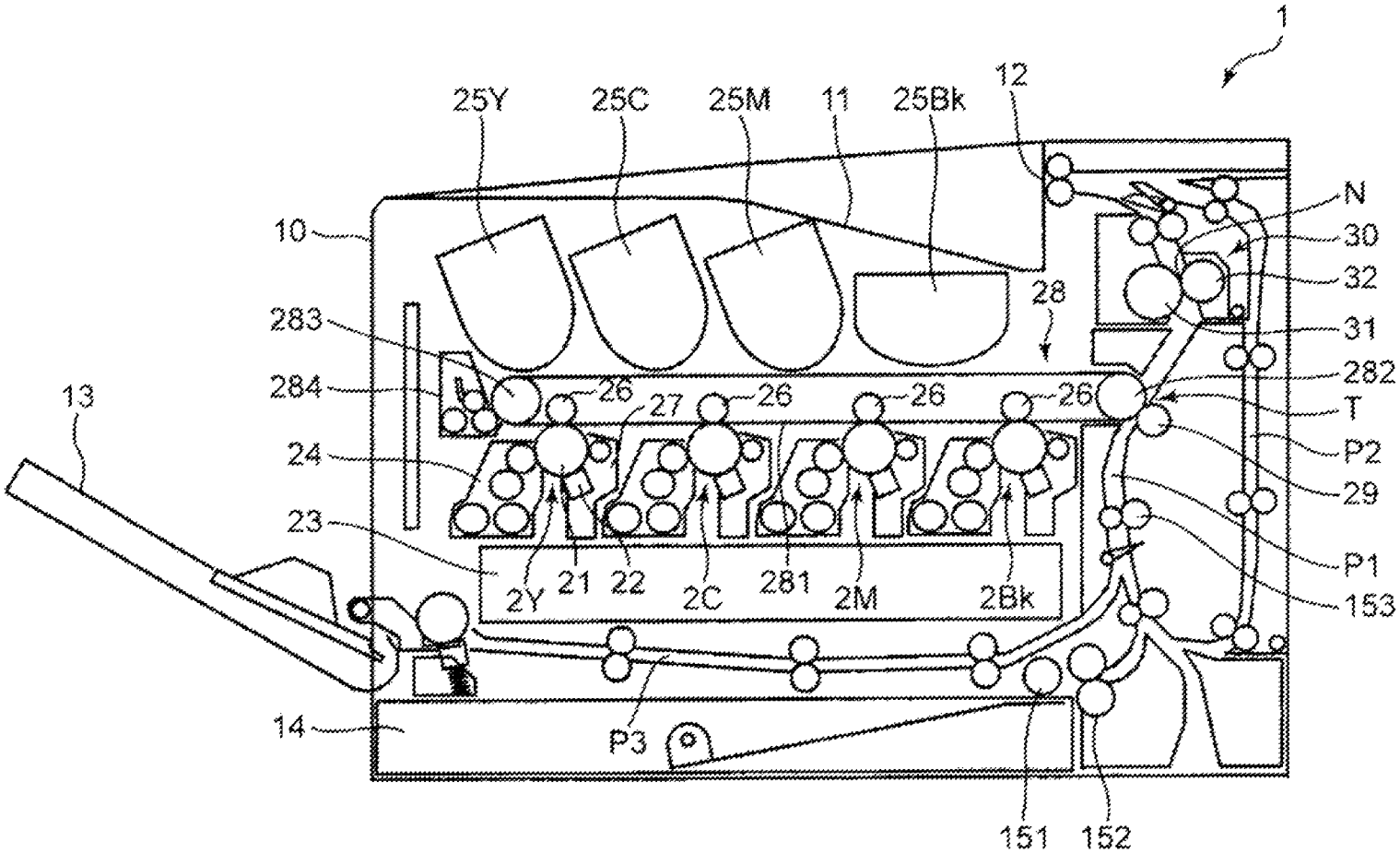
FIG. 1 is a schematic cross-sectional view of an internal structure of an image forming apparatus according to one embodiment of the present disclosure.

Hereinafter, embodiments of the present disclosure will be described in detail with reference to the drawings. FIG. 1 is a schematic cross-sectional view of an internal structure of an image forming apparatus 1 according to the embodiments of the present disclosure. The image forming apparatus 1 is a color printer, and includes a main body housing 10 formed as a housing having a substantially rectangular parallelepiped shape.

The main body housing 10 includes therein a plurality of processing units that perform image forming process on sheets. In the present embodiment, image forming units 2Y, 2C, 2M, and 2Bk, a laser scanning unit 23, an intermediate transfer unit 28, and a fixing device 30 are provided as the processing units. A sheet discharge tray 11 is provided on the top surface of the main body housing 10. A sheet discharge outlet 12 is opened so as to oppose the sheet discharge tray 11. Further, a manual sheet feed tray 13 is mounted on the side wall of the main body housing 10 so as to be openable and closable. A sheet feed cassette 14 that stores sheets on which the image forming process is performed is detachably mounted in the lower portion of the main body housing 10.

The image forming units 2Y, 2C, 2M, and 2Bk are aligned at predetermined intervals in the horizontal direction in the tandem manner. The image forming units 2Y, 2C, 2M, and 2Bk form yellow, cyan, magenta, and black toner images, respectively, based on image information transmitted from an external device such as a computer. Each of the image forming units 2Y, 2C, 2M, and 2Bk includes a photosensitive drum 21, a charging device 22, the laser scanning unit 23, a developing device 24, a corresponding one of the toner containers 25Y, 25C, 25M, and 25Bk, a primary transfer roller 26, and a cleaning device 27. The photosensitive drum 21 carries an electrostatic latent image and a toner image. By the charging device 22, the circumferential surface of the photosensitive drum 21 is charged. The laser scanning unit 23 forms an electrostatic latent image on the circumferential surface of the photosensitive drum 21. By the developing device 24, developer is adhered to the electrostatic latent image to form a toner image. The toner containers 25Y, 25C, 25M, and 25Bk supply yellow, cyan, magenta, and black toners to the developing devices 24, respectively. The primary transfer roller 26 performs primary transfer of the toner image formed on the photosensitive drum 21. The cleaning device 27 removes residual toner on the circumferential surface of the photosensitive drum 21.

The intermediate transfer unit 28 performs primary transfer of the toner image formed on the photosensitive drum 21. The intermediate transfer unit 28 includes a transfer belt 281 that circulates while contacting with the circumferential surface of each photosensitive drum 21, and a driving roller 282 and a follower roller 283 on which the transfer belt 281 is extended. The transfer belt 281 is pressed against the circumferential surface of each photosensitive drum 21 by the primary transfer roller 26. The toner image of each color on the photosensitive drum 21 is superposed on the same portion on the transfer belt 281, and primarily transferred. Thus, a full color toner image is formed on the transfer belt 281.

A secondary transfer roller 29 is disposed so as to oppose the driving roller 282 and sandwich the transfer belt 281 between the secondary transfer roller 29 and the driving roller 282, thereby forming a secondary transfer nip portion T. The full color toner image on the transfer belt 281 is secondarily transferred to a sheet at the secondary transfer nip portion T. Toner that is not transferred to the sheet and remains on the circumferential surface of the transfer belt 281 is recovered by a belt cleaning device 284 opposing the follower roller 283.

The fixing device 30 includes a fixing roller 31 having a heat source therein, and a pressure roller 32 that forms a fixing nip portion N in conjunction with the fixing roller 31. The fixing device 30 performs fixing process in which the sheet to which the toner image has been transferred at the secondary transfer nip portion T is heated and pressurized at the fixing nip portion N to fuse and fix toner on the sheet. The sheet having been subjected to the fixing process is discharged through the sheet discharge outlet 12 toward the sheet discharge tray 11. The fixing device 30 will be described below in detail.

A sheet conveying path in which a sheet is conveyed is disposed in the main body housing 10. The sheet conveying path includes a main conveying path P1 that extends, in the up-down direction, from the vicinity of the lower portion to the vicinity of the upper portion of the main body housing 10 through the secondary transfer nip portion T and the fixing device 30. The downstream end of the main conveying path P1 connects with the sheet discharge outlet 12. A reverse conveying path P2 in which a sheet is reversed and conveyed for both-side printing extends from the downstream endmost portion to the vicinity of the upstream end of the main conveying path P1. A manual sheet feed conveying path P3 is disposed above the sheet feed cassette 14 so as to extend from the manual sheet feed tray 13 to the main conveying path P1.

The sheet feed cassette 14 includes a sheet storage portion in which a stack of sheets is stored. A pickup roller 151 that feeds the stacked sheets one by one by feeding an uppermost sheet, and a pair of sheet feed rollers 152 that feeds the sheets toward the upstream end of the main conveying path P1, are provided near the upper right portion of the sheet feed cassette 14. The sheet placed on the manual sheet feed tray 13 is also fed through the manual sheet feed conveying path P3 toward the upstream end of the main conveying path P1. A pair of registration rollers 153 that sends the sheet to the transfer nip portion at a predetermined time is disposed upstream of the secondary transfer nip portion T in the main conveying path P1.

In the case of one-side printing (image formation) process being performed on a sheet, a sheet is fed from the sheet feed cassette 14 or the manual sheet feed tray 13 into the main conveying path P1, and the sheet is subjected to the transfer process in which a toner image is transferred to the sheet at the secondary transfer nip portion T, and subjected to the fixing process in which the transferred toner is fixed onto the sheet by the fixing device 30. Thereafter, the sheet is discharged through the sheet discharge outlet 12 onto the sheet discharge tray 11. On the other hand, in the case of both-side printing process being performed on a sheet, the transfer process and the fixing process are performed on one side of the sheet, and a part of the sheet is thereafter discharged through the sheet discharge outlet 12 onto the sheet discharge tray 11. Thereafter, conveyance of the sheet is switched and the sheet is returned through the reverse conveying path P2 to the vicinity of the upstream end of the main conveying path P1. Thereafter, the transfer process and the fixing process are performed on the other side of the sheet, and the sheet is discharged through the sheet discharge outlet 12 onto the sheet discharge tray 11.

First Embodiment

Figure 2:
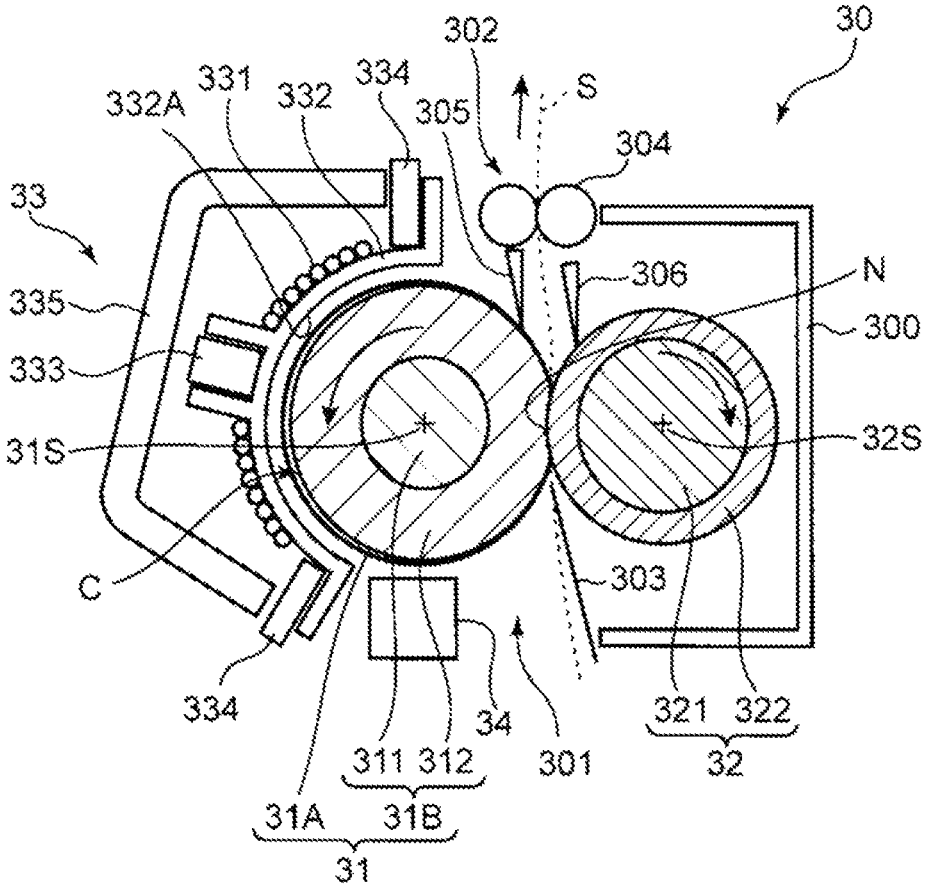
FIG. 2 is a cross-sectional view of a fixing device, according to a first embodiment, which is incorporated in the image forming apparatus according to one embodiment of the present disclosure.

Hereinafter, a structure of the fixing device 30 will be described in detail. FIG. 2 is a schematic cross-sectional view of the fixing device 30 according to the first embodiment. The fixing device 30 includes the fixing roller 31 and the pressure roller 32 which are described above, a heating device 33 that is of an induction-heating type and that heats the fixing roller 31, a temperature sensor 34 that detects a temperature of the fixing roller 31, and a fixing housing 300 that accommodates these components.

The fixing housing 300 includes an entrance opening 301 through which a sheet S is received from the secondary transfer nip portion T, and a discharge outlet 302 through which the sheet S having been subjected to the fixing process is sent out.

At the entrance opening 301, a guide plate 303 that guides the sheet S toward he fixing nip portion N is disposed. Further, at the discharge outlet 302, a pair of conveying rollers 304 that sends the sheet S having passed through the fixing nip portion N, downstream through the discharge outlet 302 is disposed.

The fixing roller 31 includes a rotation axis 31S that extends in the front-rear direction (a direction perpendicular to the sheet surface of FIG. 2). The pressure roller 32 includes a rotation axis 32S that extends parallel to the rotation axis 31S in the front-rear direction. The fixing roller 31 and the pressure roller 32 are supported in the fixing housing 300 so as to be rotatable about the rotation axes 31S and 32S, respectively. In the present embodiment, a rotation driving force is applied to the pressure roller 32 so as to rotate the pressure roller 32 clockwise, and the fixing roller 31 rotates counter-clockwise so as to follow the rotation of the pressure roller 32.

The fixing roller 31 includes an elastic roller member 31B, and a fixing belt 31A that is fitted onto the roller member 31B with a predetermined clearance C. The roller member 31B includes a shaft 311 that extends in the front-rear direction (one direction), and an elastic layer 312 that is formed integrally on the shaft 311. The fixing roller 31 rotates about the axis of the shaft 311 which corresponds to the rotation axis 31S. The shaft 311 may be, for example, a metal core formed of an SUS or the like. The elastic layer 312 may be, for example, a resin foam layer formed of a silicone sponge or the like. The fixing belt 31A may be, for example, a multilayered endless belt that includes: a magnetic metal base member that is formed of nickel or the like and can be induction-heated; an elastic layer formed of a silicone rubber or the like; and a surface separation layer formed of a fluorine-based resin or the like.

The pressure roller 32 includes a shaft 321, and a roller layer 322 that is formed integrally on the shaft 321. The shaft 321 may be, for example, a non-magnetic metal core formed of aluminium or the like. The roller layer 322 is a layer that has a rigidity higher than the elastic layer 312 of the fixing roller 31, and may be, for example, a layer formed of a silicone rubber or the like. A separation layer is preferably formed on the outer circumference of the roller layer 322. A rotation driving force is applied to the shaft 321 of the pressure roller 32 from a not-illustrated driving mechanism, and the pressure roller 32 thus rotates about the axis of the shaft 321 which corresponds to the rotation axis 32S.

The fixing roller 31 is pressed against the pressure roller 32 with a predetermined pressure. Thus, the circumferential surface of the fixing roller 31 (fixing belt 31A) contacts with the circumferential surface of the pressure roller 32 in a state where the circumferential surface of the fixing roller 31 is pressed and deformed into a recessed arc shape. The contact portion corresponds to the fixing nip portion N. The sheet S to be subjected to the fixing process enters the fixing housing 300 through the entrance opening 301, and is nipped at the fixing nip portion N, and conveyed by the fixing roller 31 and the pressure roller 32 rotating about the rotation axes 31S and 32S, respectively. When the sheet S is conveyed in the fixing nip portion N, the sheet S is heated and pressurized. Thereafter, the sheet S is discharged through the discharge outlet 302 by the pair of conveying rollers 304.

A separation member 305 for a sheet is disposed, downstream of the fixing nip portion N in the rotation direction, on the circumferential surface of the fixing roller 31. The separation member 305 is a plate-like member that has almost the same dimension as the width, in the axial direction, of the fixing belt 31A. Further, separation claws 306 for a sheet are disposed, downstream of the fixing nip portion N in the rotation direction, on the circumferential surface of the pressure roller 32. The number of the separation claws 306 is plural, and the plural separation claws 306 are disposed along the axial direction of the pressure roller 32. The separation member 305 and the separation claws 306 are disposed so as to separate the sheet S that has passed through the fixing nip portion N, from the circumferential surfaces of the fixing roller 31 and the pressure roller 32, when the sheet S is wound around the circumferential surface of the fixing roller 31 or the pressure roller 32.

The heating device 33 includes a coil 331 to which high-frequency voltage is applied for the induction heating, a bobbin 332 around which the coil 331 is wound, and magnetic cores 333, 334, and 335 that form a magnetic path of a magnetic field generated by the coil 331. The bobbin 332 includes a curved inner surface 332A formed along the outer circumferential shape of the fixing roller 31, and the curved inner surface 332A is positioned so as to oppose the circumferential surface of the fixing roller 31. The magnetic core 333 is a center core, and is disposed at the center of the bobbin 332 in a cross-sectional view. The paired magnetic cores 334 are side cores, and are disposed near the end portions of the bobbin 332. The magnetic core 335 is an arch-shaped core, and is positioned so as to bridge between the paired magnetic cores 334. When high-frequency voltage is applied, the coil 331 generates a magnetic field, and a magnetic path that passes through the fixing belt 31A is formed due to actions of the magnetic cores 333, 334, and 335. Thus, an eddy current flows through the magnetic metal base member of the fixing belt 31A to heat the fixing belt 31A.

The temperature sensor 34 is a non-contact sensor such as a thermistor, and detects a surface temperature of the fixing roller 31 (fixing belt 31A). The detected surface temperature is transmitted to a not-illustrated control portion, and the control portion adjusts high frequency voltage to be applied to the coil 331, based on the surface temperature, thereby adjusting a density of magnetic flux generated by the coil 331.

Figure 3:
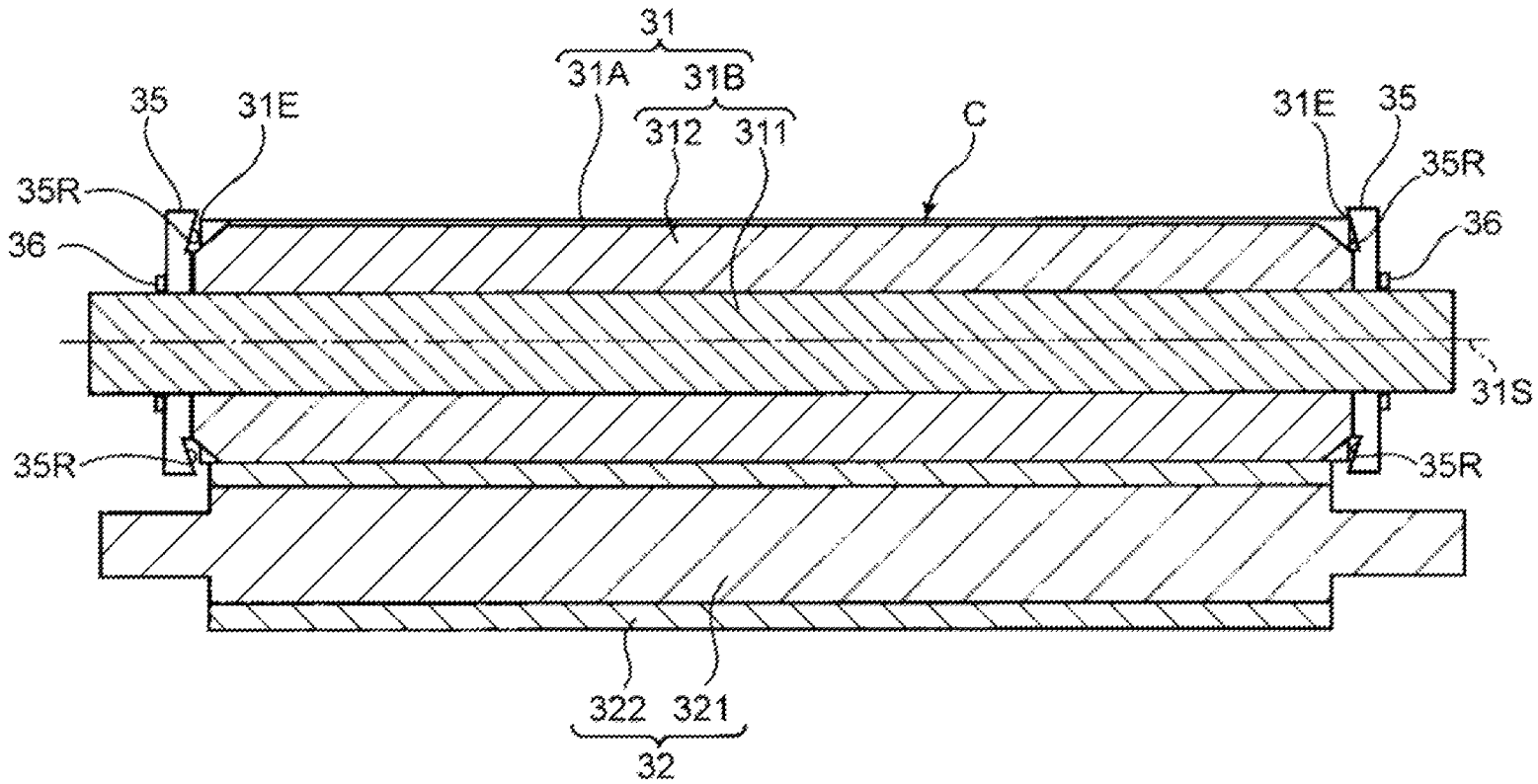
FIG. 3 is a cross-sectional view, taken along a rotation axis direction, of the fixing device according to one embodiment of the present disclosure.
Figure 4:
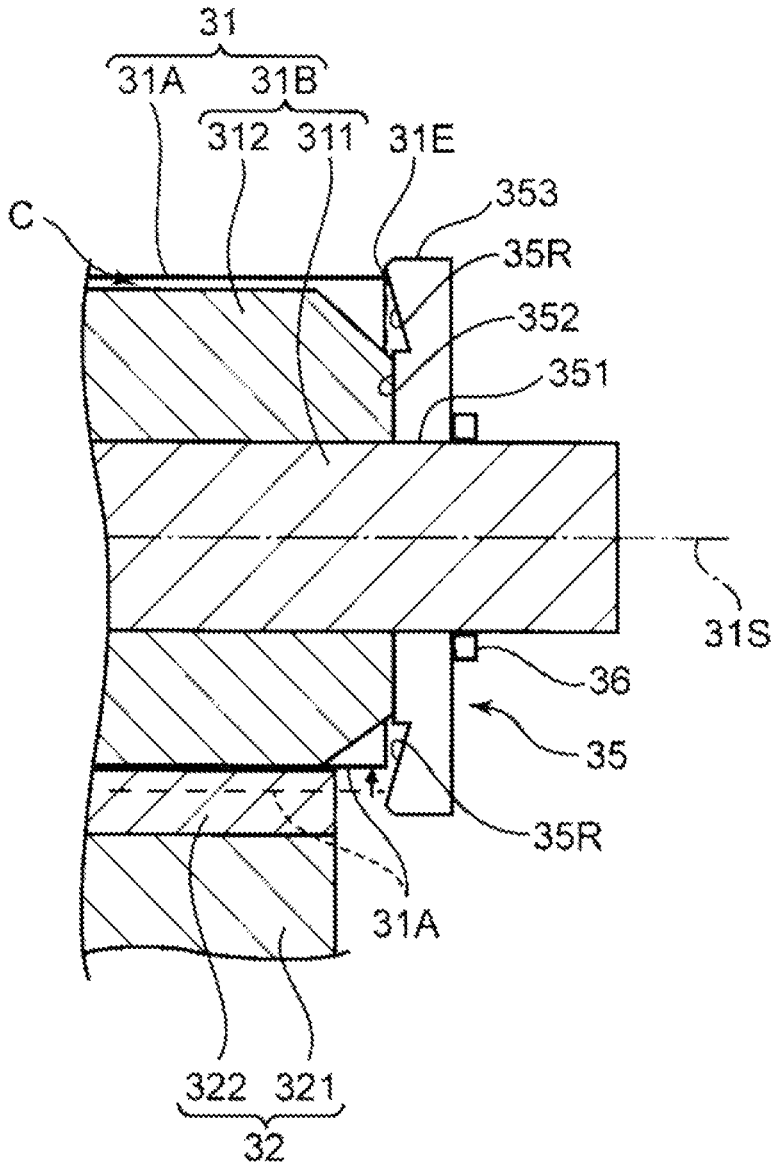
FIG. 4 is an enlarged cross-sectional view of a main portion in FIG. 3.
Figure 5:
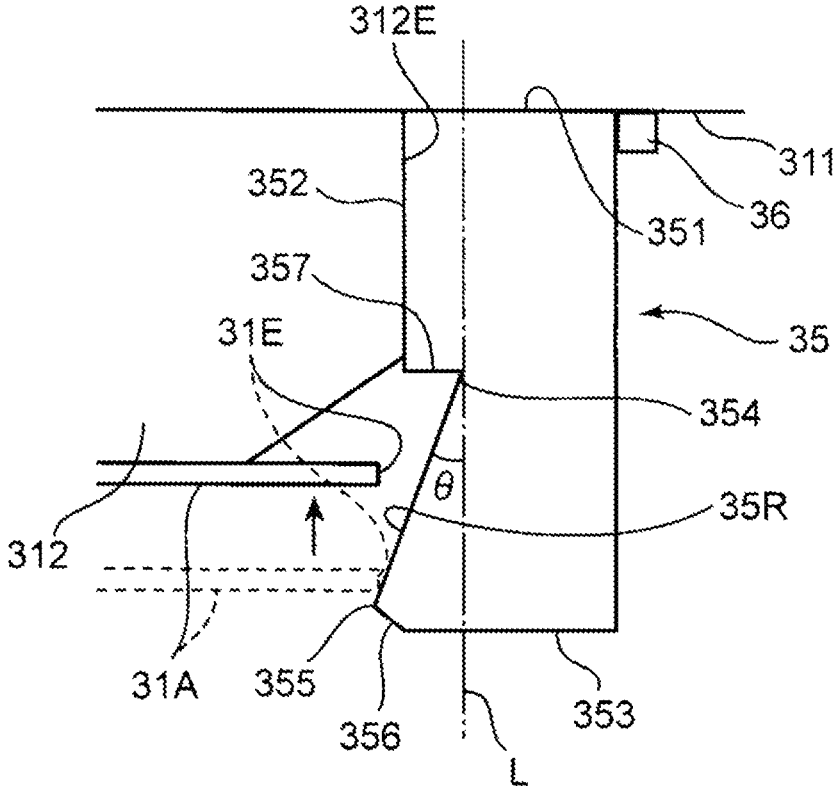
FIG. 5 is an enlarged cross-sectional view of a main portion in FIG. 4, illustrating an action of a regulation surface.
Figure 6:
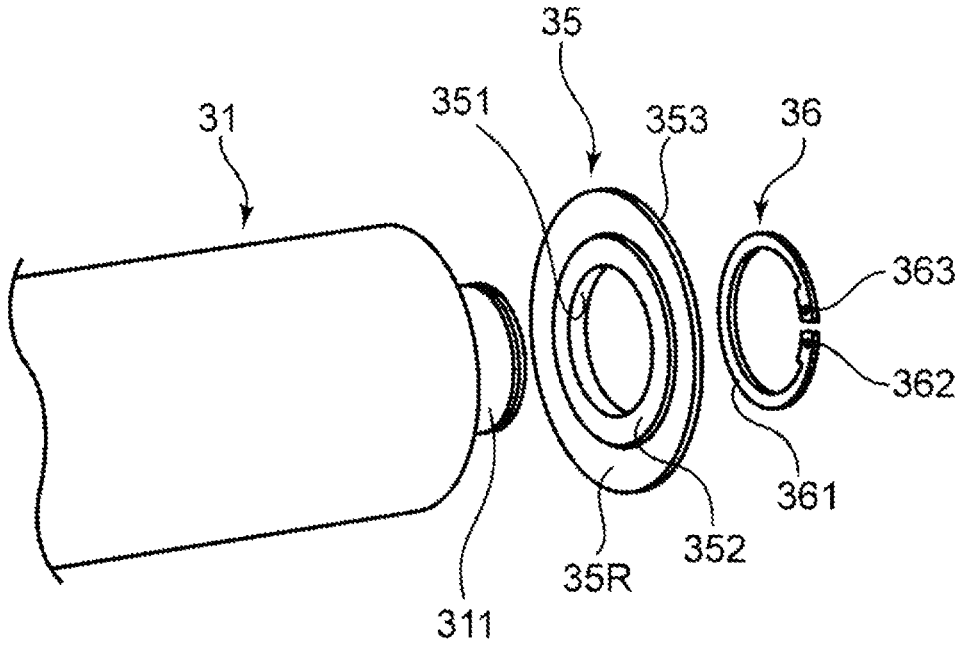
FIG. 6 is an exploded perspective view of the main portion in FIG. 3.

FIG. 3 is a cross-sectional view, of the fixing device 30 according to the first embodiment, taken along a direction parallel to the rotation axis 31S. FIG. 4 is an enlarged cross-sectional view of a main portion in FIG. 3. In FIGS. 3 and 4, only the fixing roller 31 and the pressure roller 32 are illustrated. Regulation members 35 that regulate movement of the fixing belt 31A in the direction along the rotation axis 31S are disposed on both end portions of the shaft 311 of the fixing roller 31. Each regulation member 35 includes an annular regulation surface 35R that opposes a side edge 31E, in the belt width direction (direction in which the rotation axis 31S extends), of the fixing belt 31A. FIG. 5 is an enlarged view of the regulation surface 35R, and FIG. 6 is an exploded perspective view of a region near the end portion of the shaft 311.

A method for regulating meander of the fixing belt 31A by the regulation members 35 being disposed has a problem that fatigue failure or abrasion of the side edges 31E may occur due to friction between the regulation surfaces 35R and the side edges 31E of the fixing belt 31A. Further, when an outer circumferential wall by which the fixing belt 31A is prevented from moving outward of the regulation member 35 in the radial direction, is provided in the regulation member 35, the outer diameter of the regulation member 35 is increased in accordance therewith. Therefore, from the viewpoint that the fixing device 30 needs to be compact, the outer circumferential wall is not preferable. On the other hand, in the fixing device 30 of the present disclosure, movement of the fixing belt 31A in the axial direction is regulated while preventing damage of the side edges 31E of the fixing belt 31A, and request for making the apparatus compact is met.

The fixing belt 31A has an inner diameter that is greater than the outer diameter of the roller member 31B at room temperature. Therefore, in a state where the fixing belt 31A is fitted onto the roller member 31B, there is a clearance C therebetween. When the elastic layer 312 of the roller member 31B is thermally expanded due to rise of temperature caused by the fixing device 30 being operated, the inner circumferential surface of the fixing belt 31A and the outer circumferential surface of the roller member 31B come into close contact with each other. Before the close contact state occurs, the fixing belt 31A may meander in the direction along the rotation axis 31S of the fixing roller 31. Therefore, movement of the fixing belt 31A in the direction along the rotation axis 31S needs to be regulated. The regulation members 35 are mounted on both end portions of the shaft 311 in order to regulate the movement of the fixing belt 31A.

Each regulation member 35 is a disk-shaped member, and includes a hole 351 formed at the center of the disk-shaped member, and an annular flat surface 352, the regulation surface 35R, and an outer circumferential surface 353 that are sequentially formed around the hole 351. The hole 351 is a circular hole having an inner diameter corresponding to the outer diameter of the shaft 311 having a circular cylindrical shape. The end portion of the shaft 311 is inserted into the hole 351. The annular flat surface 352 is a flat plane that opposes a side edge of the elastic layer 312 of the roller member 31B. The regulation surface 35R is an inclined surface that is consecutively disposed outward of the annular flat surface 352 in the radial direction. The outer circumferential surface 353 is consecutively disposed outward of the regulation surface 35R in the radial direction so as to be parallel to the rotation axis 31S.

A stop ring 36 is mounted outward of a position at which the regulation member 35 is mounted, in the direction along the rotation axis 31S. The stop ring 36 includes a main body portion 361 having an inner diameter that is slightly less than the outer diameter of the shaft 311, and end portions 362, 363 that are end portions of the main body portion 361 and that oppose each other with a gap therebetween. The diameter of the stop ring 36 is increased so as to increase the gap between the end portions 362 and 363, and the stop ring 36 is fitted onto the shaft 311 in a state where the stop ring 36 has a fastening force. The inner side surface of the stop ring 36 contacts with the reverse side surface of the annular flat surface 352 of the regulation member 35, to prevent the regulation member 35 from moving beyond the end portion of the shaft 311.

Next, the regulation surface 35R will be mainly described in detail with reference to FIG. 5. Each regulation surface 35R is an annular surface that opposes the side edge 31E of the fixing belt 31A, and is a flat surface that is inclined by an angle θ relative to a perpendicular line L that is perpendicular to the rotation axis 31S as viewed on the cross-section parallel to the rotation axis 31S. The regulation surface 35R is inclined from the rotation axis 31S side such that the closer the regulation surface 35R is to the outside, in the radial direction, of the fixing roller 31, the closer the regulation surface 35R is to the center, in the length direction, of the shaft 311. Namely, as viewed at the side edge 31E of the fixing belt 31A, the regulation surface 35R has such a tapered mortar-shaped surface that the closer the regulation surface 35R is to the rotation axis 31S, the deeper the tapered mortar-shaped surface is. The angle θ can be selected so as to satisfy $0° < \theta < 40°$, preferably, $3° < \theta < 30°$.

An inner diameter portion 354 is a portion of the regulation surface 35R which is closest to the rotation axis 31S, and is positioned so as to be recessed outward of the annular flat surface 352 in the axial direction. Therefore, when the fixing belt 31A is at its regular position in the width direction, namely, when the side edge 31E and a side edge 312E of the elastic layer 312 are almost aligned with each other as viewed from the rotation axis 31S, the inner diameter portion 354 does not contact with the side edge 31E, and the inner diameter portion 354 is a portion farthest from the side edge 31E. On the other hand, an outer diameter portion 355 is an outermost portion, in the radial direction, of the regulation surface 35R, and projects slightly inward of the side edge 312E in the axial direction. Namely, when the fixing belt 31A is at its regular position, the outer diameter portion 355 is positioned inward of the side edge 31E of the fixing belt 31A in the axial direction.

A C-surface (chamfered portion) 356 is disposed at a boundary portion between the outer side portion, in the radial direction, of the regulation surface 35R, and the outer circumferential surface 353, that is, the C-surface 356 is disposed between the outer diameter portion 355 and the inner side end portion, in the axial direction, of the outer circumferential surface 353. Further, a stepped surface 357 is disposed in a boundary portion between the inner side portion, in the radial direction, of the regulation surface 35R and the annular flat surface 352, so as to be parallel to the rotation axis 31S.

The diameter at the inner diameter portion 354 is less than the diameter of the elastic layer 312. The diameter at the inner diameter portion 354 is determined such that the relationship in diameter size does not change even when the foams of the elastic layer 312 are broken and the diameter of the elastic layer 312 is reduced due to the apparatus being used over years. On the other hand, the diameter at the outer diameter portion 355 is greater than a sum of the diameter of the elastic layer 312 and the thicknesses of the fixing belt 31A. Therefore, the side edge 31E of the fixing belt 31A opposes an inclined surface between the inner diameter portion 354 and the outer diameter portion 355.

The function of the regulation surfaces 35R will be described. By the pressure roller 32 being driven to rotate, the fixing roller 31 (fixing belt 31A) rotates so as to follow the rotation of the pressure roller 32. When thermal expansion of the elastic layer 312 is insufficient, there is the clearance C between the fixing belt 31A and the elastic layer 312, and the fixing belt 31A may oscillate relative to the roller member 31B. A case will be assumed where the fixing belt 31A moves in the direction (axial direction) in which the rotation axis 31S extends (the fixing belt 31A moves rightward in FIG. 4 and FIG. 5) while the fixing roller 31 rotates so as to follow the rotation of the pressure roller 32. In this case, the side edge 31E of the fixing belt 31A contacts with the regulation surface 35R. Therefore, the fixing belt 31A is prevented from moving rightward in the axial direction from that position. Namely, meander of the fixing belt 31A is regulated.

The fixing belt 31A may oscillate in the direction orthogonal to the axial direction as well as in the axial direction. This is because, when the fixing roller 31 is pressed against the pressure roller 32 in the presence of the clearance C, the fixing belt 31A is deformed into an ellipsoidal shape. Namely, the fixing belt 31A is deformed into an ellipsoidal shape as viewed from the side surface thereof such that a minor axis direction corresponds to a first direction formed by connection between the fixing nip portion N and the rotation axis 31S, and a major axis direction corresponds to a second direction orthogonal to the first direction. The regulation members 35 rotate integrally with the fixing roller 31. Therefore, at portions, in the circumferential direction, of each regulation surface 35R, the side edge 31E moves in the radial direction so as to switch from the minor axis state to the major axis state and moves in the radial direction for the opposite switching.

FIG. 5 illustrates a state where the side edge 31E of the fixing belt 31A moves in the radial direction so as to switch from the major axis state (dotted line) to the minor axis state (solid line). In this case, even in a case where, in the major axis state, the side edge 31E is in contact with the regulation surface 35R, when the side edge 31E moves in the radially inward direction, the contact between the side edge 31E and the regulation surface 35R can be cancelled since the regulation surface 35R is an inclined surface. Namely, the regulation surface 35R is such an inclined surface that the closer the regulation surface 35R is to the inner side in the radial direction, the closer the regulation surface 35R is to outside in the axial direction. Therefore, the side edge 31E that moves toward the inner side in the radial direction is away from the regulation surface 35R. Therefore, the side edge 31E and the regulation surface 35R do not rub each other, thereby preventing damage of the side edge 31E.

Figure 7:
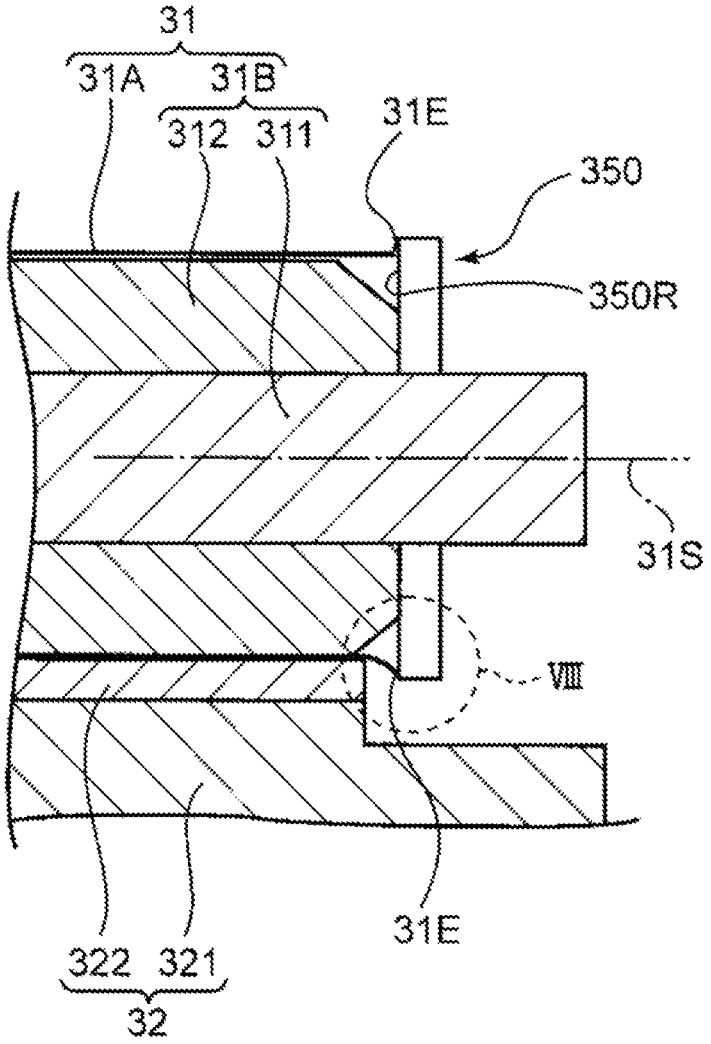
FIG. 7 is a cross-sectional view of a fixing device according to a comparative example.
Figure 8:
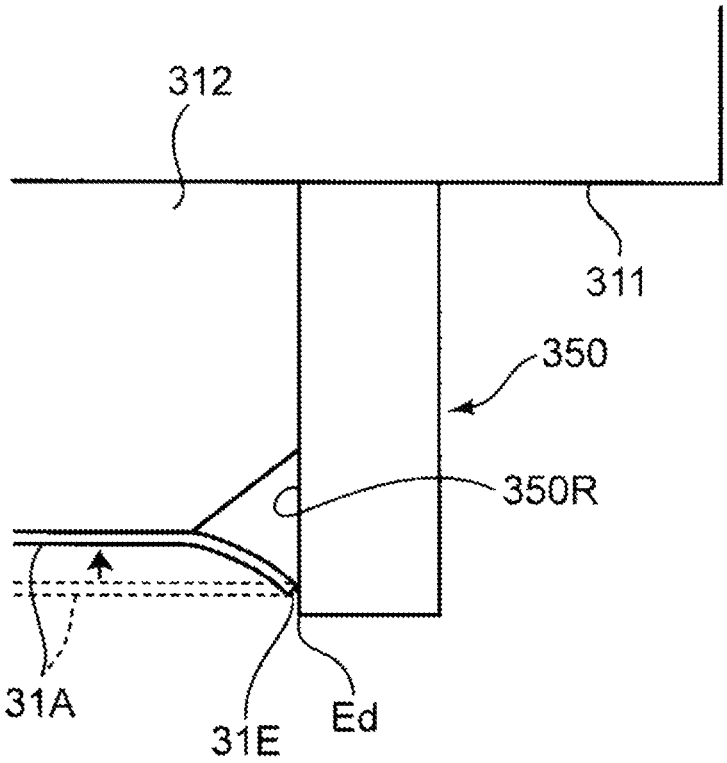
FIG. 8 illustrates an action of a regulation surface according to the comparative example.

In a case where the regulation surface 35R is a flat surface that does not include an inclined surface, the advantageous effect as described above cannot be obtained. FIG. 7 is a cross-sectional view of a fixing device having a regulation member 350 according to a comparative example. FIG. 8 is an enlarged view of a portion VIII in FIG. 7, and illustrates an action of a regulation surface 350R according to the comparative example. The regulation surface 350R of the regulation member 350 is included in a surface opposing the side edge 31E of the fixing belt 31A, and is a flat surface orthogonal to the rotation axis 31S.

In this case, in a case where the side edge 31E of the fixing belt 31A moves in the radial direction so as to switch from the major axis state (dotted line in FIG. 8) to the minor axis state (solid line), when the side edge 31E is in contact with the regulation surface 350R, the side edge 31E may not follow the movement of the fixing belt 31A in the radial direction. Namely, since the regulation surface 350R is a flat surface, even when the side edge 31E moves toward the inner side the radial direction, the contact between the side edge 31E and the regulation surface 350R is not cancelled. Therefore, the side edge 31E may be left at a position in the major axis state due to frictional force, and a portion of the fixing belt 31A near the side edge 31E may be bent and deformed so as to be trumpet-shaped as shown in FIG. 8. If the fixing belt 31A is thus bent and deformed, fatigue failure may occur at this portion. Further, even when the fixing belt 31A is not bent and deformed, the side edge 31E and the regulation surface 350R may constantly slide on and rub each other, whereby cutting of the side edge 31E may occur. When, as in the present embodiment, the regulation surface 35R has an inclined surface, the problem that the above-described fatigue failure or cutting occurs can be solved.

Figure 9A:
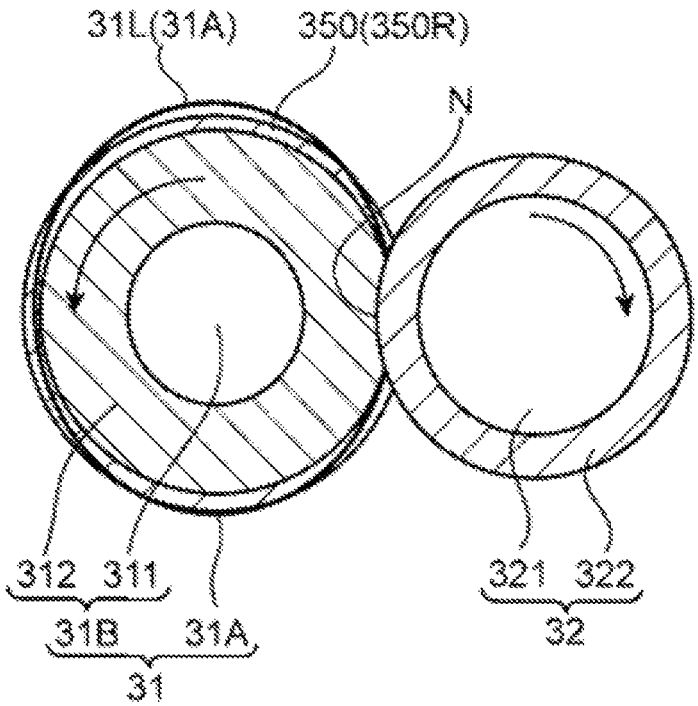
FIG. 9A and FIG. 9B illustrate an action of the regulation surface according to the comparative example.
Figure 9B:
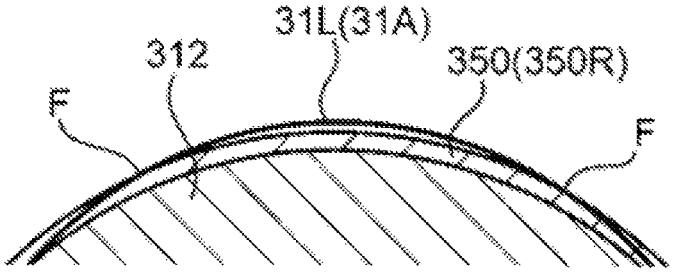

Further, when the regulation surface 35R has the inclined surface, it is advantageous that the circularity of the rotation trajectory of the fixing belt 31A can be obtained more assuredly. The regulation surface 350R that does not have the above-described inclined surface will be firstly described for comparison with reference to FIG. 9A and FIG. 9B. FIG. 9A is a cross-sectional view of a fixing device having the regulation member 350 according to the comparative example, and FIG. 9B is an enlarged view of the main portion thereof. As described above, when the fixing roller 31 is pressed against the pressure roller 32 in the presence of the clearance C, the fixing belt 31A is deformed into an ellipsoidal shape. Since the regulation surface 350R is a flat surface, an effect of positively retaining the side edge 31E cannot be expected while a retaining effect is exhibited to some degree due to the frictional force as described above.

Therefore, the fixing belt 31A can be freely deformed according to the clearance C, and a relatively large major axis portion 31L is formed. At the major axis portion 31L, the diameter of the fixing belt 31A is greater than the outer diameter of the regulation member 350, and the side edge 31E may move outward of the regulation surface 350R in the radial direction. In this case, an intersecting portion F in which the side edge 31E of the fixing belt 31A moves across an edge Ed (FIG. 8) of the regulation member 350 (the regulation surface 350R) is generated. At the intersecting portion F, the side edge 31E may be cut due to contact with the edge Ed. Further, when the fixing belt 31A is greatly deformed into an ellipsoidal shape, a problem arises that a strength against buckling in the axial direction may be reduced. For example, when the fixing belt 31A meanders greatly in the axial direction, and the side edge 31E is strongly pressed against the regulation surface 350R, there is a concern for buckling of the fixing belt 31A.

Figure 10:
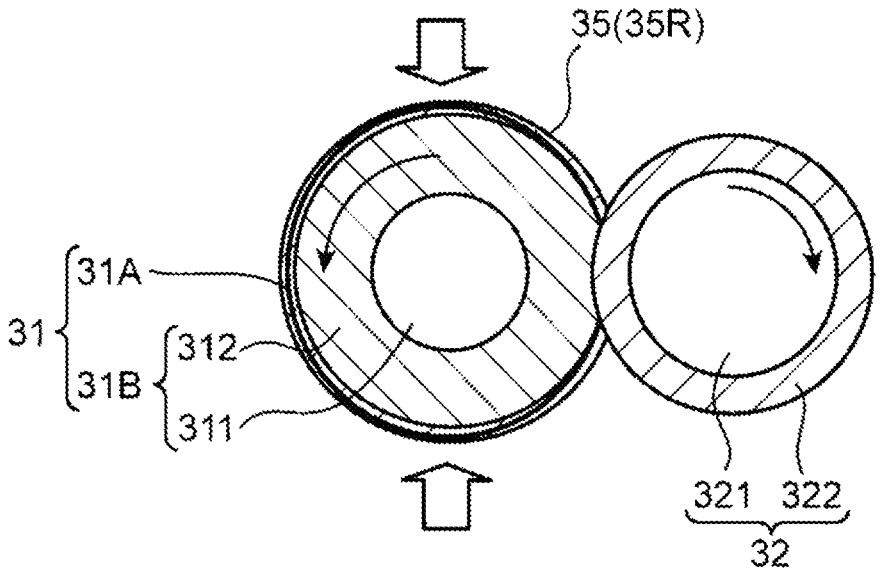
FIG. 10 illustrates an action of the regulation surface according to the first embodiment.

On the other hand, since the regulation surface 35R of the present embodiment has the above-described inclined surface, the side edge 31E of the fixing belt 31A is guided so as to approach the rotation shaft due to the inclined surface. Namely, as shown in FIG. 10, the inclination enables the side edge 31E to be prevented from moving outward of the regulation surface 35R in the radial direction. This is because a force for returning the major axis portion of the fixing belt 31A toward the radially inward direction indicated by arrows in FIG. 10 is generated by the regulation surface 35R that is mortar-shaped, and expansion of the major axis portion is prevented. This contributes to maintaining the fixing belt 31A so as to form almost an exact circle in the cross-sectional view when the fixing roller 31 rotates. Therefore, contact of the side edge 31E of the fixing belt 31A with the edge of the regulation member 35 can be prevented as much as possible. Further, since the circularity of the fixing belt 31A can be assuredly obtained, strength, in the axial direction, against buckling of the fixing belt 31A can be enhanced.

Even when a part of the side edge 31E of the fixing belt 31A moves outward of the regulation surface 35R in the radial direction, to reach the outer circumferential surface 353, the part of the side edge 31E can be easily returned. Namely, in the present embodiment, the C-surface 356 is formed, between the outer diameter portion 355 and the outer circumferential surface 353, by an edge portion therebetween being cut. Therefore, even when a part of the side edge 31E is moved onto the outer circumferential surface 353, the part of the side edge 31E can be moved along the C-surface 356 in the radially inward direction in a state where the part of the side edge 31E is subjected to no stress. Further, since the edge portion is eliminated, damage and wear of the fixing belt 31A due to sliding and friction can be prevented.

Figure 11:
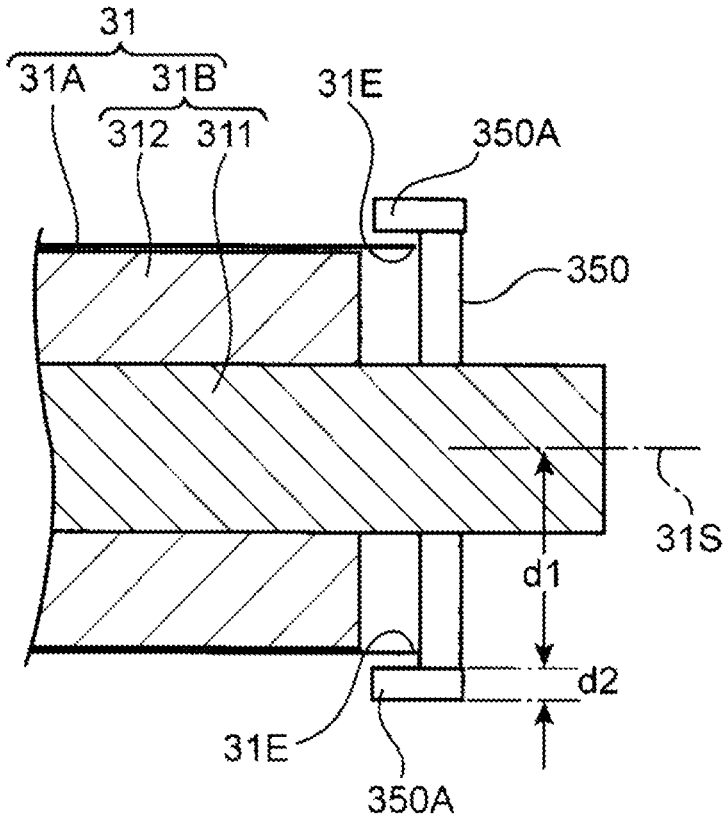
FIG. 11 is a cross-sectional view of a fixing device according to another comparative example.

Further, in the present embodiment, since the regulation surface 35R also has a function of regulating movement of the side edge 31E so as not to move the side edge 31E outward of the regulation surface 35R in the radial direction, the regulation surface 35R can contribute to making the fixing device 30 compact. FIG. 11 is a cross-sectional view of a fixing device according to another comparative example. In the comparative example, a ring wall 350A is disposed on the outer circumference of the regulation member 350 indicated in the comparative example shown in FIG. 7 and FIG. 8, and the ring wall 350A regulates movement of the side edge 31E so as not to move the side edge 31E outward of the regulation member 350 in the radial direction. In this comparative example, since the side edge 31E is surrounded by the ring wall 350A, the side edge 31E is prevented from moving outward of the regulation member 350 in the radial direction, and the circularity of the fixing belt 31A can be assuredly obtained. However, since a thickness d2 of the ring wall 350A is added to the radius d1 of the regulation member 350 itself, the radius of the fixing roller 31 in an assembled state is increased.

In FIG. 2, when the fixing roller 31 in the assembled state includes a partially increased radius portion, the heating device 33 needs to be disposed according to the increased radius portion. When a member such as the ring wall 350A described above is mounted, a distance between the heating device 33 and the fixing roller 31 needs to be increased in order to avoid interference with the bobbin 332 or assuredly obtain electrical insulation. Therefore, the fixing device 30 cannot be made compact. Further, measures need to be taken according to the increased distance such that high frequency current that flows through the coil 331 is enhanced, the number of turns in the coil 331 is increased, or power supply frequency is enhanced. Any of these measures is not preferable since loss in the coil 331 may be increased.

On the other hand, in the regulation member 35 of the present embodiment, the outer circumferential surface 353 is disposed outward of the regulation surface 35R in the radial direction so as to connect through the C-surface 356 with the regulation surface 35R and be parallel to the rotation axis 31S. Namely, nothing is substantially provided outward of the regulation surface 35R in the radial direction. Therefore, the size of the regulation member 35 can be minimized, and the heating device 33 can be disposed so as to be close to the fixing roller 31 in the assembled state. This can contribute to making the fixing device 30 compact. Further, in the present embodiment, the fixing belt 31A is heated in an induction heating manner, and the dimension of the regulation member 35 in the radial direction can be reduced. Therefore, the distance between the bobbin 332 and the fixing belt 31A can be minimized, and this can contribute to making the fixing device 30 compact.

Second Embodiment

Figure 12:
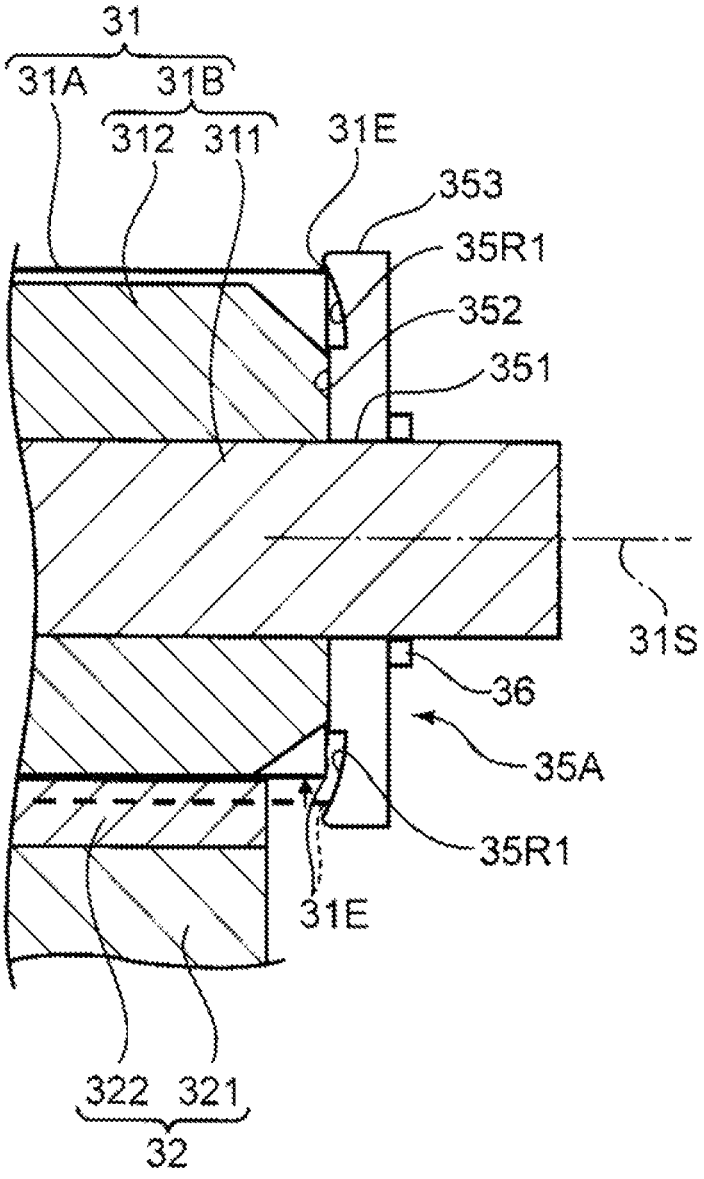
FIG. 12 is a cross-sectional view of a fixing device according to a second embodiment.
Figure 13:
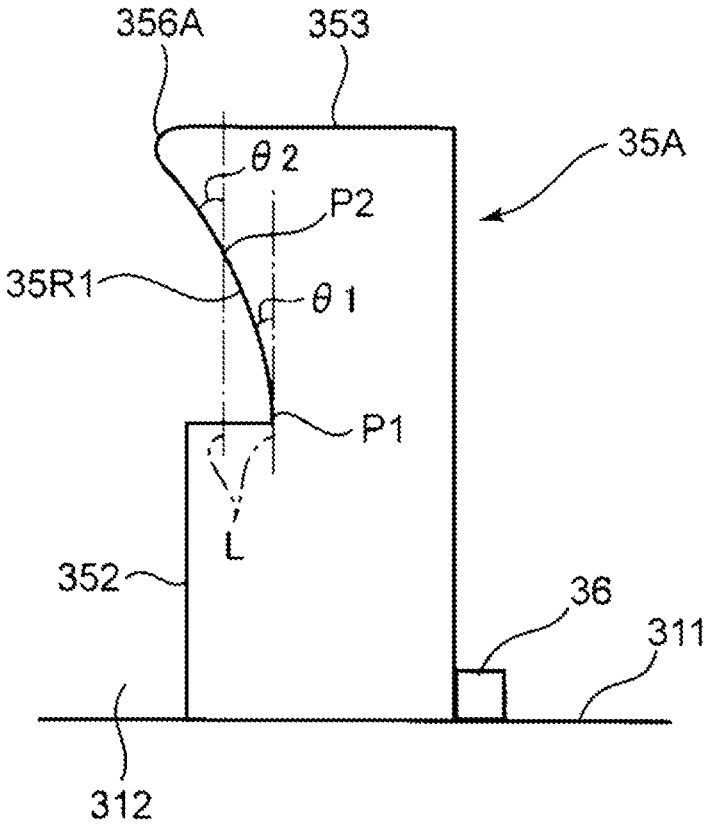
FIG. 13 illustrates an action of a regulation surface according to the second embodiment.
Figure 14:
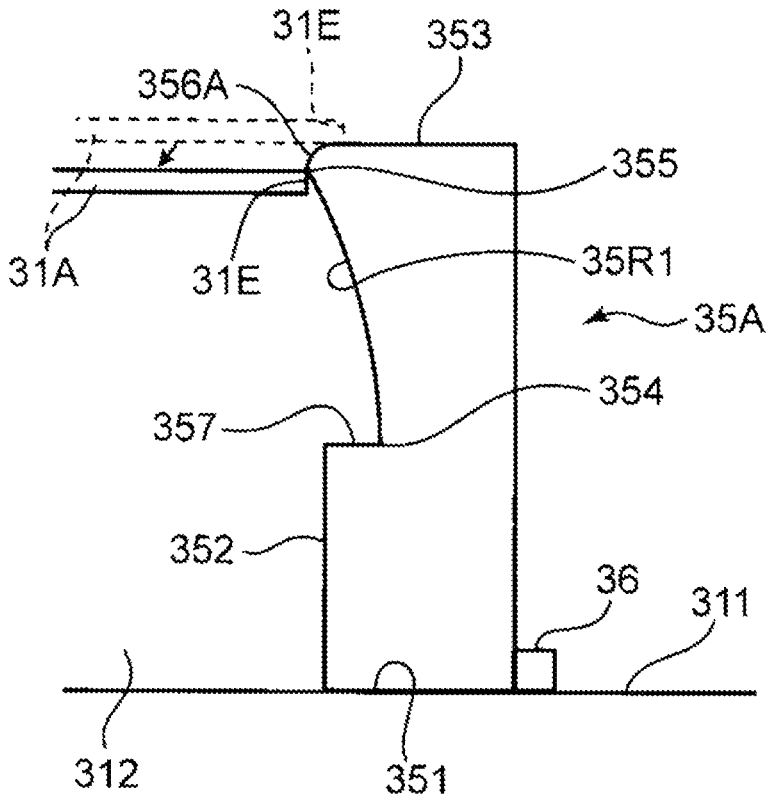
FIG. 14 illustrates another action of the regulation surface according to the second embodiment.

FIG. 12 is a cross-sectional view, taken along the rotation axis 31S, of a fixing device including a regulation member 35A according to a second embodiment. FIG. 13 and FIG. 14 illustrate an action of a regulation surface 35R1 of the regulation member 35A. The same components as described for the first embodiment are denoted by the same reference numerals, and the description thereof will be omitted or simplified.

The regulation member 35A is different from the regulation member 35 of the first embodiment in the following two points. That is, in the regulation member 35A, the regulation surface 35R1 is a curved inclined surface instead of a flat inclined surface, and, as a chamfered portion formed between the regulation surface 35R1 and the outer circumferential surface 353, an R-surface 356A is formed.

FIG. 13 illustrates the curved inclined surface of the regulation surface 35R1. The regulation surface 35R1 is the same as the regulation surface 35R of the first embodiment in that the regulation surface 35R1 is inclined from the rotation axis 31S side such that the closer the regulation surface 35R1 is to the outside, in the radial direction, of the fixing roller 31, the closer the regulation surface 35R1 is to the center, in the length direction, of the shaft 311. However, the regulation surface 35R1 is inclined such that, when θ1 represents an inclination angle of the regulation surface 35R1 relative to a line L perpendicular to an inner region (point P1), in the radial direction, of the regulation surface 35R1, and θ2 represents an inclination angle of the regulation surface 35R1 relative to a line L perpendicular to an outer region (point P2), in the radial direction, of the regulation surface 35R1, θ2>θ1 is satisfied.

Namely, the regulation surface 35R1 has such a curved surface that the inclination relative to the perpendicular line L is increased toward the outer side, in the radial direction, of the regulation surface 35R1. When the regulation surface 35R1 has such a curved surface, an effect of regulating movement of the side edge 31E of the fixing belt 31A so as not to move the side edge 31E outward of the regulation surface 35R1 in the radial direction, can be enhanced. Further, improvement of regulation of the outward movement leads to enhancement of circularity of the fixing belt 31A.

FIG. 14 illustrates an action of the R-surface 356A. The R-surface 356A is a curved surface positioned at a boundary portion between the outer side, in the radial direction, of the regulation surface 35R1 and the outer circumferential surface 353, that is, positioned between the outer diameter portion 355 and the inner end portion, in the axial direction, of the outer circumferential surface 353. Even when a part of the side edge 31E of the fixing belt 31A is moved onto the outer circumferential surface 353 (dotted line in FIG. 14), the R-surface 356A enables the part of the side edge 31E to move along the R-surface 356A in the radially inward direction in a state where the part of the side edge 31E is subjected to no stress. Further, since no edge portion is positioned between the regulation surface 35R1 and the outer circumferential surface 353, damage and wear of the fixing belt 31A due to sliding and friction can be prevented.

Third Embodiment

Figure 15:
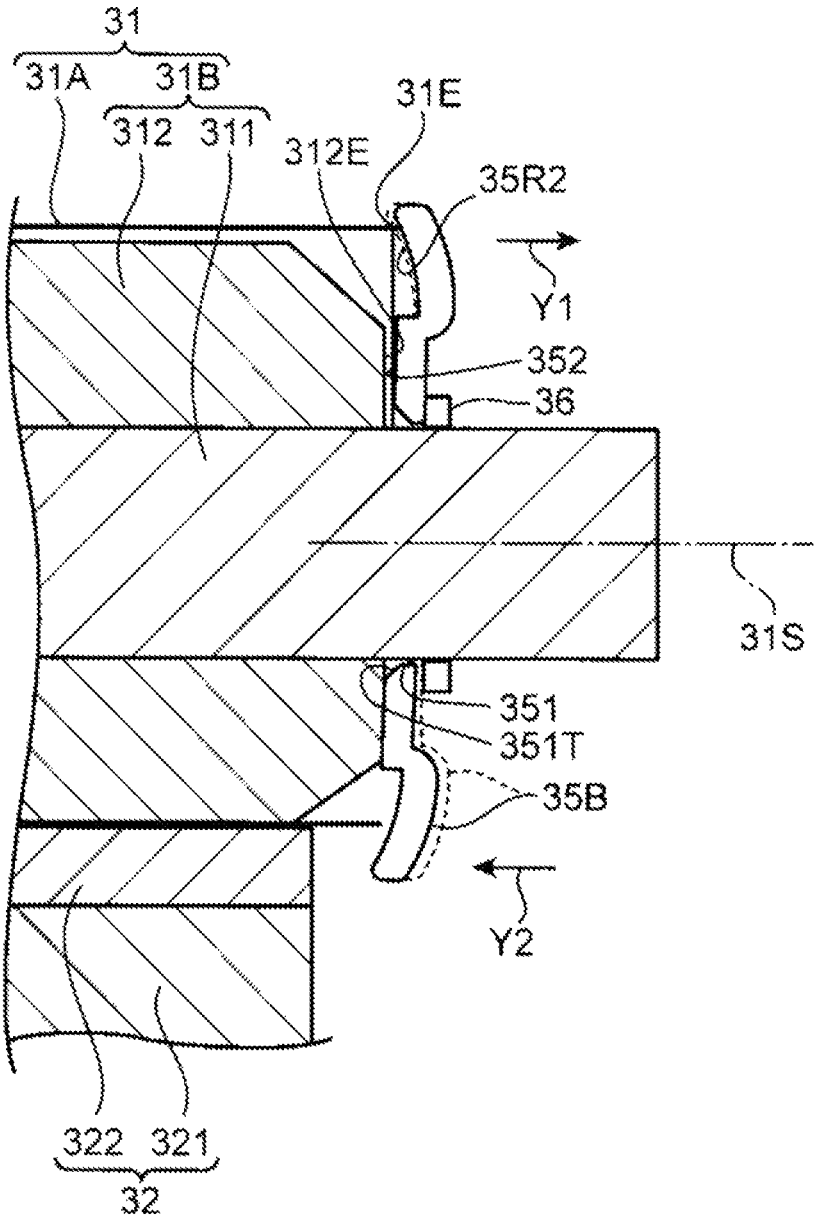
FIG. 15 is a cross-sectional view of a fixing device according to a third embodiment.

FIG. 15 is a cross-sectional view, taken along the rotation axis 31S, of a fixing device including a regulation member 35B according to a third embodiment. The same components as described for the first embodiment are denoted by the same reference numerals, and the description thereof will be omitted or simplified. The regulation member 35B is different from the regulation member 35 of the first embodiment in that the regulation member 35B is allowed to be inclined by a predetermined angle relative to a line orthogonal to the rotation axis 31S.

The regulation member 35B includes an inclined regulation surface 35R2. A small gap is formed between the circumferential surface of the shaft 311 and a hole wall that defines a hole 351 which is formed at the center of the regulation member 35B and into which the shaft 311 is inserted. Namely, the regulation member 35B is fitted such that there is a play between the regulation member 35B and the shaft 311. A tapered surface 351T by which the diameter of the hole is gradually increased is provided on the inner side, in the axial direction, of the hole wall of the hole 351. The stop ring 36 is fixed such that a distance between a side surface (contacting position) of the stop ring 36 which contacts with the reverse surface of the annular flat surface 352 and the side edge 312E of the elastic layer 312 (roller member 31B) is longer than the thickness of the regulation member 35B. Namely, the stop ring 36 that prevents the regulation member 35B from moving outward is provided such that there is a clearance between the side edge 312E of the elastic layer 312, and the annular flat surface 352.

In this structure, the regulation member 35B is allowed to be inclined, in a range corresponding to the gap and the clearance, relative to the line orthogonal to the rotation axis 31S. An exemplary case will be assumed where the fixing belt 31A suddenly meanders for some reasons, and the side edge 31E of the fixing belt 31A may hit against the regulation surface 35R2 with a strong force. In this case, if the regulation member 35B is rigidly fixed, the side edge 31E may be damaged.

However, in the present embodiment, the regulation member 35B is allowed to be inclined by a predetermined angle. In FIG. 15, a position of the regulation member 35B as indicated by a dotted line represents a position of the regulation member 35B that is not inclined. If, in this state, an upper portion of the side edge 31E hits against the regulation surface 35R2 with a strong force, as shown in FIG. 15, a pressing forces in the axially outward direction is applied to the upper portion of the regulation surface 35R2 as indicated by an arrow Y1. On the other hand, a force of moving a lower portion of the regulation surface 35R2 in the axially inward direction is applied to the regulation surface 35R2 in reaction, as indicated by an arrow Y2. Therefore, the regulation member 35B is inclined from the position indicated by the dotted line toward the position indicated by the solid line. This inclination may reduce impact of hitting of the side edge 31E. Therefore, occurrence of damage of the side edge 31E can be prevented.

As described above, the fixing device 30 and the image forming apparatus 1 using the fixing device 30 according to the above embodiments allow movement of the fixing belt 31A in the axial direction to be regulated without damaging the side edge 31E of the fixing belt 31A. Further, the request to make compact the fixing device 30 which uses the induction-heating type heating device 33 can be met.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing roller including a roller member having a shaft which extends in one direction and an elastic layer integrally formed on the shaft and a fixing belt fitted onto the roller member, the fixing roller configured to rotate about an axis of the shaft as a rotation axis;

a pressure roller configured to form a fixing nip portion between the pressure roller and the fixing roller; and a respective regulation member mounted at each end portion of the shaft, each regulation member having an annular regulation surface which opposes a side edge of the fixing belt, each regulation member configured to regulate movement of the fixing belt in a rotation axis direction, wherein the regulation surface is inclined relative to a line perpendicular to the rotation axis as viewed on a cross-section parallel to the rotation axis, the regulation surface is inclined from the rotation axis side such that the closer the regulation surface is to an outside, in a radial direction, of the fixing roller, the closer the regulation surface is to a center, in a length direction, of the shaft, the regulation surface is inclined such that, when $\theta 1$ represents an inclination angle of an inner region, in the radial direction, of the regulation surface relative to the line perpendicular to the rotation axis, and $\theta 2$ represents an inclination angle of an outer region, in the radial direction, of the regulation surface relative to the line perpendicular to the rotation axis, $\theta 2 > \theta 1$ is satisfied, each regulation member is a disk-shaped member, each regulation member includes a hole into which the shaft is inserted, an annular flat surface opposing a side edge of the elastic layer of the roller member and being parallel to the side edge of the elastic layer, the regulation surface connecting with an outer side portion, in the radial direction, of the annular flat surface, and an outer circumferential surface connecting with an outer side portion, in the radial direction, of the regulation surface so as to be parallel to the rotation axis, and the elastic layer of the roller member includes an inclined surface whose diameter gradually decreases toward the side edge of the elastic layer, wherein a chamfered portion is provided in a boundary portion between the outer side portion, in the radial direction, of the regulation surface, and the outer circumferential surface.

2. The fixing device according to claim 1, further comprising respective stop rings configured to prevent each regulation member from moving beyond the end portions of the shaft, wherein each stop ring contacts with the respective regulation member at a reverse side surface of the annular flat surface, a distance between a position where each stop ring contacts with the respective regulation member, and the side edge of the roller member is set so as to be greater than a thickness of the respective regulation member, a gap that allows each regulation member to be inclined relative to the line perpendicular to the rotation axis by a predetermined angle in the case of the side edge of the fixing belt hitting against the regulation surface is generated between a hole wall that defines the hole of the regulation member, and a circumferential surface of the shaft.

3. The fixing device according to claim 1, wherein the regulation members are mounted to each end portion of the shaft such that each regulation member can be inclined relative to the line perpendicular to the rotation axis by a predetermined angle in the case of the side edge of the fixing belt hitting against the regulation surface.

4. The fixing device according to claim 1, further comprising a heating device configured to heat the fixing belt by induction heating, wherein the heating device includes a bobbin having a shape corresponding to a shape of an outer circumferential surface of the fixing roller and disposed so as to oppose the fixing roller, and a coil which is wound around the bobbin and to which a high frequency voltage is applied for the induction heating.

5. An image forming apparatus comprising an image forming portion that transfers a toner image on a sheet, and a fixing device that fixes the toner image onto the sheet, wherein the fixing device includes:

a fixing roller including:

a roller member having a shaft which extends in one direction and an elastic layer integrally formed on the shaft and a fixing belt fitted onto the roller member, the fixing roller configured to rotate about an axis of the shaft as a rotation axis;

a pressure roller configured to form a fixing nip portion between the pressure roller and the fixing roller; and a regulation member mounted at end portions of the shaft, each regulation member having an annular regulation surface which opposes a side edge of the fixing belt, each regulation member configured to regulate movement of the fixing belt in a rotation axis direction, the regulation surface is inclined relative to a line perpendicular to the rotation axis as viewed on a cross-section parallel to the rotation axis, the regulation surface is inclined from the rotation axis side such that the closer the regulation surface is to an outside, in a radial direction, of the fixing roller, the closer the regulation surface is to a center, in a length direction, of the shaft, the regulation surface is inclined such that, when θ1 represents an inclination angle of an inner region, in the radial direction, of the regulation surface relative to the line perpendicular to the rotation axis, and θ2 represents an inclination angle of an outer region, in the radial direction, of the regulation surface relative to the line perpendicular to the rotation axis, θ2>θ1 is satisfied, each regulation member is a disk-shaped member, each regulation member includes a hole into which the shaft is inserted, an annular flat surface opposing a side edge of the elastic layer of the roller member and being parallel to the side edge of the elastic layer, the regulation surface connecting with an outer side portion, in the radial direction, of the annular flat surface, and an outer circumferential surface connecting with an outer side portion, in the radial direction, of the regulation surface so as to be parallel to the rotation axis, and the elastic layer of the roller member includes an inclined surface whose diameter gradually decreases toward the side edge of the elastic layer, wherein a chamfered portion is provided in a boundary portion between the outer side portion, in the radial direction, of the regulation surface, and the outer circumferential surface.

6. The image forming apparatus according to claim 2, further comprising respective stop rings configured to prevent each regulation member from moving beyond the end portions of the shaft, wherein each stop ring contacts with the respective regulation member at a reverse side surface of the annular flat surface, a distance between a position where each stop ring contacts with the respective regulation member, and the side edge of the roller member is set so as to be greater than a thickness of the respective regulation member, and a gap that allows each regulation member to be inclined relative to the line perpendicular to the rotation axis by a predetermined angle in the case of the side edge of the fixing belt hitting against the regulation surface is generated between a hole wall that defines the hole of the regulation member, and a circumferential surface of the shaft.

7. The image forming apparatus according to claim 5, wherein the regulation members are mounted to each end portion of the shaft such that each regulation member can be inclined relative to the line perpendicular to the rotation axis by a predetermined angle in the case of the side edge of the fixing belt hitting against the regulation surface.

8. The image forming apparatus according to claim 5, further comprising a heating device configured to heat the fixing belt by induction heating, wherein the heating device includes:

a bobbin having a shape corresponding to a shape of an outer circumferential surface of the fixing roller and disposed so as to oppose the fixing roller, and a coil which is wound around the bobbin and to which a high frequency voltage is applied for the induction heating.

* * * * *